United States Patent [19]

Bubnich et al.

[11] 4,318,077

[45] Mar. 2, 1982

[54] VEHICLE PARKING AID

[76] Inventors: Frank J. Bubnich; Marketta A. Bubnich, both of 3224 Emmaus, Zion, Ill. 60099

[21] Appl. No.: 88,830

[22] Filed: Oct. 29, 1979

[51] Int. Cl.[3] ..... G08G 1/14; B60Q 1/48

[52] U.S. Cl. ..... 340/51; 340/61; 200/61.25; 200/61.41; 116/218

[58] Field of Search ..... 340/51, 61, 626, 666; 200/61.24, 61.25, 61.26, 61.41, 61.6, 85 R, 86 R, 61.83; 116/218, DIG. 7, DIG. 8, DIG. 9

[56] References Cited

U.S. PATENT DOCUMENTS 4,145,681 3/1979 Bubnich et al. ..... 340/51

*Primary Examiner*—John W. Caldwell, Sr.

*Assistant Examiner*—Donnie L. Crosland

*Attorney, Agent, or Firm*—Merriam, Marshall & Bicknell

[57] ABSTRACT

A vehicle parking aid and signaling device having a housing section which encloses an electrical circuit connected with an electric switch for opening and closing the circuit and the circuit operatively connected with a signaling light or buzzer. The switch is actuated by having a movable lever arm maintained in direct engagement with an expandable elastic bulb which is operatively connected with a deformable tubular member filled with a fluid and which causes the elastic bulb to expand momentarily and effect closing of the electrical circuit containing the signaling light or buzzer when a wheel of a vehicle moves over and compresses the deformable tubular member; thereby indicating when the vehicle has reached a predetermined position.

4 Claims, 6 Drawing Figures

FIG. 1
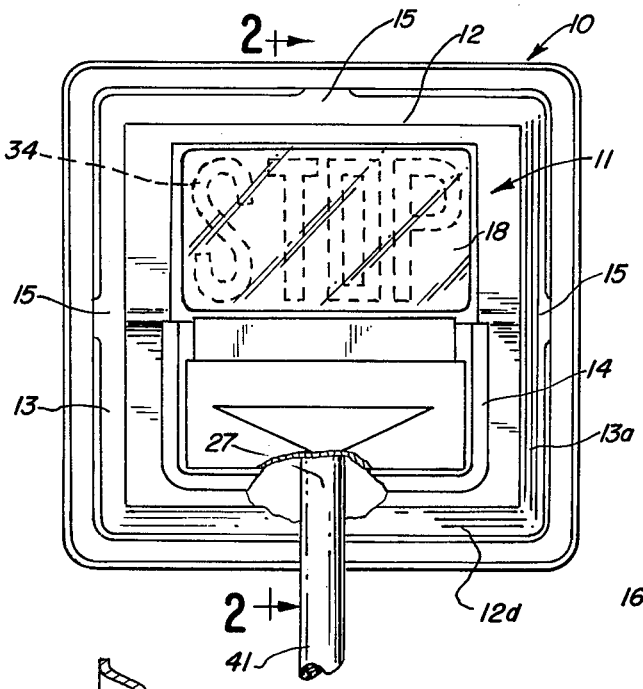
FIG. 3
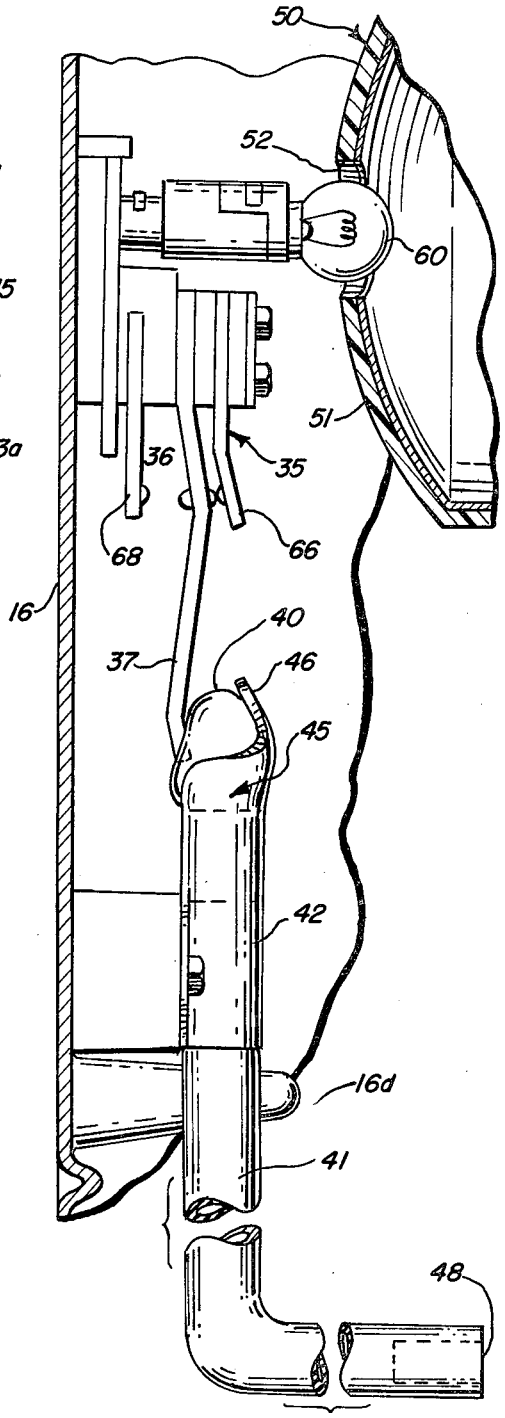
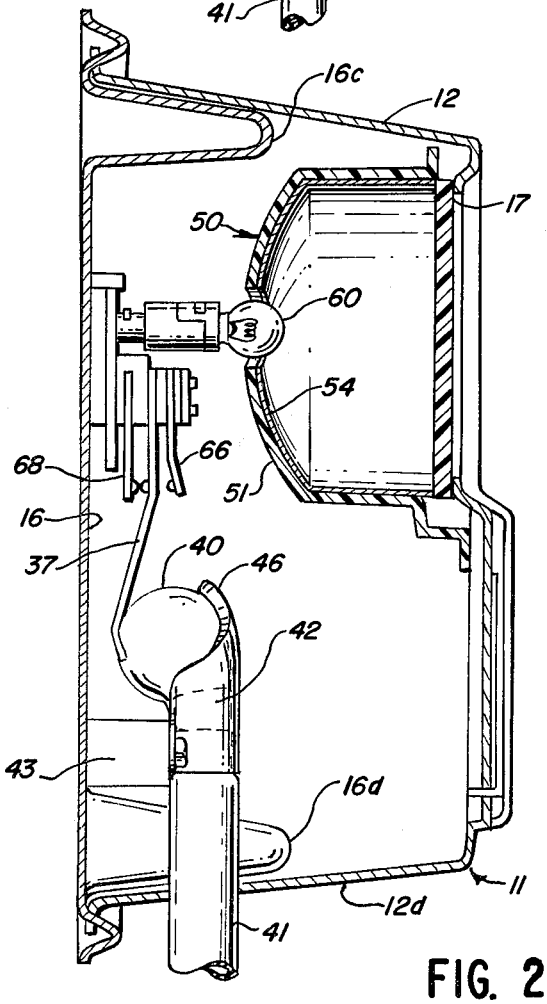
FIG. 2

FIG. 4
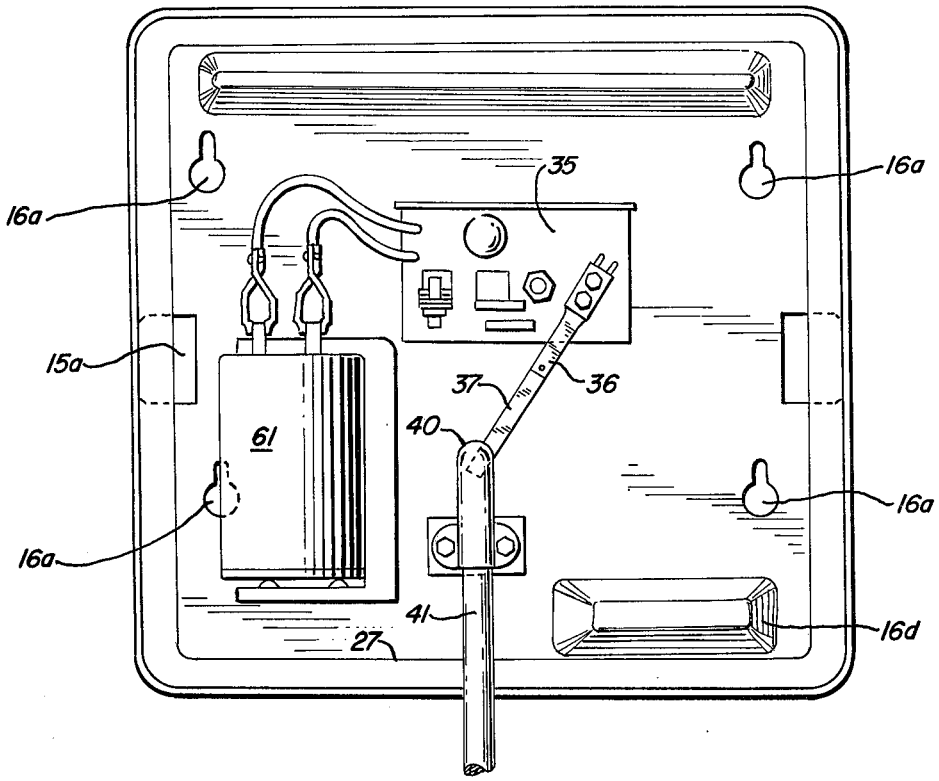
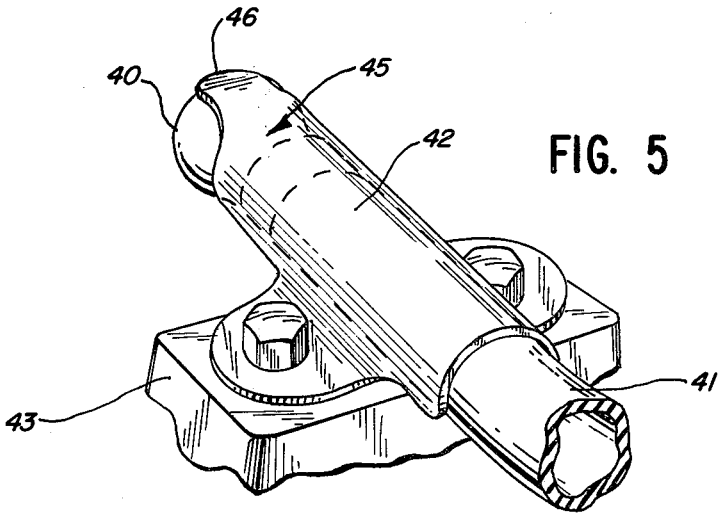
FIG. 5
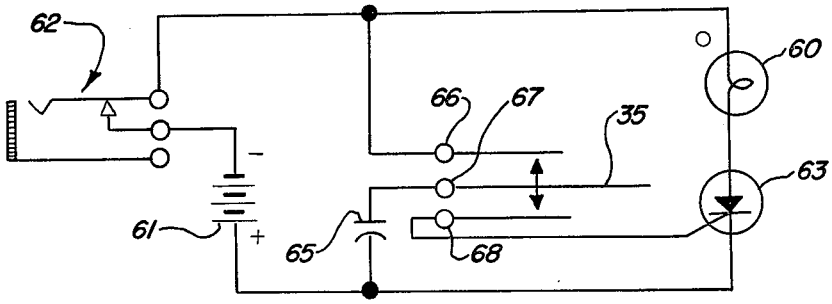
FIG. 6

VEHICLE PARKING AID

The invention relates generally to a vehicle parking aid and signaling device which aids in parking a vehicle in a designated position in a garage, drive-in or the like establishment and which gives the driver of the vehicle notice when a vehicle has reached a designated position within a parking area.

Many devices have been disclosed for giving the driver of a vehicle notice when his vehicle has reached a predetermined position within a garage or parking area. Among the devices for giving a driver notice when his vehicle should be stopped to avoid damaging the car, the wall of the garage or other structure are known, among which are the devices shown in U.S. Pat. No. 2,454,896 and U.S. Pat. No. 3,219,972. Parking aid devices of the foregoing type employ relatively complex mechanical actuating means or are quite limited as to where the signal activating means can be placed relative to the vehicle and have failed to achieve wide spread commercial acceptance.

It is therefore an object of the invention to provide a more economical general purpose parking guide and signaling device which can be actuated by a motor vehicle.

It is a further object of the present invention to provide a vehicle parking guide and signaling device which employs a simpler operating mechanism which has greater flexibility in the positioning of the signal actuating means relative to the vehicle than like devices heretofore produced.

Other objects of the present invention will be apparent in the detailed description and claims to follow when read in conjunction with the accompanying drawing wherein:

FIG. 1 is a front elevational view of a parking guide and signaling device embodying the present invention;

FIG. 2 is a fragmentary vertical sectional view partially in elevation taken along the line 2—2 of FIG. 1;

FIG. 3 is a fragmentary vertical sectional view partially in elevation of the device of FIG. 2 in a different operative position;

FIG. 4 is a rear elevational view of the apparatus of FIG. 1 partially disassembled;

FIG. 5 is a perspective view of the bracket-cap section shown in FIGS. 2–4; and FIG. 6 is a schematic diagram of an electrical circuit which can be used in the present invention.

A vehicle parking guide and signaling device 10 embodying the present invention comprises a generally rectangular housing section 11 which includes upper and lower walls 12, 12*a*, respectively, lateral walls 13, 13*a*, respectively, and front wall 14. The tabs 15 extending perpendicularly from the lower edges of the walls 12, 12*a*, 13, 13*a* are adapted to detachably engage in slots 15*a* formed in a backing plate 16 which comprises the rear wall of the device 10. Any suitable mounting means for securing the signaling device 10 to a vertical wall or post are provided on the backing plate 16, as by fasteners extending through the apertures 16*a* or strips of pressure sensitive tape 16*b* placed on the back of plate 16. The backing plate 16 also preferably has formed thereon upwardly and inwardly tapered guide members 16*c*, 16*d*, respectively, extending parallel to the upper and lower walls 12 and 12*a*, respectively. The guide members 16*c*, 16*d*, assist in mounting and supporting the housing section 11 on the backing plate 16.

The front wall 14 of the housing section 11 is preferably provided with a rectangular opening or window 17 which extends substantially the width of the upper portion of the front wall 14 and which is closed by a transparent or translucent plastic or glass pane 18. Mounted on the inner surface of the front wall 14 and enclosing the edges of the pane 18 is a reflector means 50 comprising a truncated semi-spherical member 51 having a small circular passage formed at the center thereof to accommodate an electric bulb 60 therein. The outer surface of the reflector means 50 is provided with a reflective, mirror-like surface coating 54. When a signal switch means 35 is actuated electric current flows to illuminate the bulb 60 and an intense beam of light is directed from the bulb 60 and the reflective surface coating 54 onto the rear surface of the pane 18 so that indicia 34 on the inner surface of the pane 18 are clearly visible when viewed from the front of the apparatus.

The rear wall 16 of the housing section 11 which has a light bulb socket mounted thereon for receiving the light bulb 60 also supports the electrical components of the device, including the electrical circuitry and the signal switch means 35 for actuating the electrical circuit which includes the light bulb 60. As best shown in FIG. 3, the switch means 35 comprises a resilient leaf switch arm 36 having an axial extending lever arm 37 which is maintained in operative engagement with a switch actuating flexible expandable means or resilient bulb 40. The resilient leaf switch arm 36 normally is allowed to remain in contact with a stationary contact terminal 66 but with the electrical circuit maintained "open" so that electric current does not flow through the bulb 60. When the switch actuating elastic bulb 40 is expanded by being inflated and moves the lever arm 37 inwardly toward the rear wall 16, the contact 67 on the movable switch arm 36 is momentarily brought into contact with the fixed electrical terminal 68. Thereafter, the elastic bulb 40 deflates and allows movable contact 67 to re-engage fixed contact 66, thereby effecting the closing of the electrical circuit containing the light bulb 60, as described herein.

The lower wall 12*d* of the housing section 11 has a passage extending therethrough to receive a deformable tubular member 41 which is filled with a fluid, such as air or liquid. The inner end of the deformable member 41 is sealably closed by the switch actuating resilient expandable means 40 which preferably is a neoprene or rubber elastic bulb mounted over the end of the deformable tubular member 41 so as to form a fluid tight engagement therewith. The deformable tubular member 41 which preferably is a resilient neoprene or rubber tube or hose is held in a fixed position within the housing section 11 by means of a bracket 42 preferably mounted on a spacer block 43 or on a forwardly extending projection molded in the back wall 16 which maintains the inner end of the tubular member 41 and the resilient elastic bulb 40 is spaced from the rear wall 16 with the elastic bulb 40 positioned within the housing section so that the end of the lever arm 37 of the switch means 35 remains in engagement with the surface of the elastic bulb 40 and electrical contacts 66, 67 in engagement when the expandable elastic bulb 40 is in normally deflated position, as when no pressure is applied on the deformable member 41.

The deformable elastic member 41 has an end cap member 45 mounted on the innermost end portion thereof. The cap member 45 preferably is formed integrally with the bracket 42 and extends upwardly to partially enclose the switch actuating flexible elastic bulb 40. The cap member 45 has a tongue-like end section 46 extending inwardly toward the rear wall 16 and the switch lever arm 37 so that when the elastic bulb 40 is expanded, as when a wheel of a vehicle passes over the deformable member 41, a maximum amount of pressure will be applied on the switch lever arm 37 to effect inward movement thereof and move the leaf switch arm 36 away from the contact terminal 66 and contact 67 into momentary engagement with the electrical contact terminal 68.

The outer end of the deformable member 41 is also sealably closed by a plug member 48 in order that the deformable member 41 will remain filled with a fluid, such as air or liquid, so that when pressure is applied to the deformable member 41 by the wheel of a vehicle passing over the deformable member 41, the elastic bulb 40 will be expanded and exert sufficient pressure on the lever arm 37 to actuate the electrical circuit, as described herein. The deformable member 41 can have a plurality of branches, as by providing a T-fitting with one branch from the T-fitting extending across one-half of a two car garage and the other branch from the T-fitting extending across the other half of the two car garage.

In FIG. 6 an electrical circuit is shown which illustrates one of several possible electrical circuits for controlling the flow of electrical current through the electric light bulb 60 or other signal means. The electric circuit shown comprises a source of electricity, such as battery 61. When 110 voltage electricity is available, a conventional converter unit 62 is provided. The battery 61 is in series with the light bulb 60 and a triac 63 which is triggered "on" by a pulse supplied by the condenser 65 when the resilient switch arm 36 is moved out of contact with terminal 66 and the terminals 67, 68, moved into electrical contact. The light bulb 60 is a flasher bulb, such as a General Electric Co. Bulb No. 455, having means for turning itself "off" after a predetermined period, such as 5 seconds, and remaining "off" during the balance of the period the actuating arm 36 maintains terminals 66, 67 in contact and will not again turn "on" until the triac 63 is again triggered.

It should be understood that a buzzer or other electrical signaling means can replace the light bulb 60 and reflector 50 or can be placed in series with the light bulb 60, if desired. Also, an electrical circuit leading to a signaling board in a location remote from the parking area can be connected in a series with the light bulb 60, if desired.

We claim:

1. A vehicle parking guide and signaling device comprising; a housing section adapted to be supported in a parking area, said housing section enclosing an electrical circuit and switch means for opening and closing said circuit operatively connected with a signaling means, said switch means having a movable lever arm associated therewith, a switch actuating resilient expandable means comprising an elastic bulb being maintained in direct engagement with said lever arm within said housing section, and said elastic bulb operatively connected with an elongated fluid filled deformable tubular member adapted to expand said elastic bulb when said deformable tubular member is deformed and move said lever arm so as to effect closing of said electrical circuit.

2. A signaling device as in claim 1, wherein one end of said deformable tubular member with said elastic bulb mounted thereon is fixedly held within said housing section by a bracket and said one end of said deformable tubular member has an end cap section mounted thereon which encloses a portion of said elastic bulb so that said bulb is adapted to expand toward said lever arm when said bulb is expanded.

3. A signaling device as in claim 2, wherein said end cap section is formed integrally with said bracket.

4. A signaling device as in claims 2 or 3, wherein said end cap section has a tongue-like portion which extends toward said lever arm causing said elastic bulb to expand essentially toward said lever arm when pressure is applied to said deformable fluid filled means; whereby maximum pressure is applied to said lever arm when said bulb is expanded.

* * * * *